US005328292A

United States Patent [19]

Williams

[11] Patent Number: 5,328,292

[45] Date of Patent: Jul. 12, 1994

[54] TRAFFIC BARRIER CHAIN

[76] Inventor: Francis R. Williams, P.O. Box 550, Canon City, Colo. 81215

[21] Appl. No.: 29,721

[22] Filed: Mar. 11, 1993

[51] Int. Cl.[5] ..... E01F 15/00

[52] U.S. Cl. ..... 404/6; 404/9

[58] Field of Search ..... 404/6, 8, 9; 49/9; 256/13.1, 1; 52/69, 71; 59/78

[56] References Cited

U.S. PATENT DOCUMENTS

| | | | |
|---|---|---|---|
| 2,313,388 | 5/1941 | McDonald | 256/1 |
| 2,346,713 | 4/1944 | Walker | 256/1 |
| 2,353,386 | 7/1944 | Bourcier | 256/1 |
| 2,906,507 | 9/1959 | Hodson | 256/1 |
| 3,387,824 | 6/1968 | Jonas et al. | 256/1 |
| 4,382,714 | 5/1983 | Hutchison | 404/9 |
| 5,123,774 | 6/1992 | Dubiel | 404/6 |

*Primary Examiner*—Ramon S. Britts
*Assistant Examiner*—Pamela O'Connor

[57] ABSTRACT

The traffic barrier was designed to give law-enforcement officers an effective traffic barrier which can be easily carried in the trunk of a car and quickly deployed across a roadway and just as quickly, removed from the roadway as the situation warrants. There is no need for assembly or mechanical procedure, the chain is simply stretched across the roadway at a right angle to the direction of traffic and pulled taut. The traffic barrier chain is designed so that no matter how the chain is placed on the road surface, half of the splines will be facing the direction of the traffic flow at an angle of 45 degrees. The other half will be facing the other direction. Deployment of the traffic barrier chain is a preferable option to using an expensive patrol car for a road block, or attempting to shoot out the tires or radiator of a vehicle. The traffic barrier chain would be a useful addition to the entries of security facilities where traditional gates are vulnerable to breech by ramming with a vehicle.

3 Claims, 1 Drawing Sheet

TRAFFIC BARRIER CHAIN

BRIEF SUMMARY OF THE INVENTION

The traffic barrier chain is a chain with splines attached to its links in such a way that when laid across a roadway, a sufficient number of the splines will be at an optimum angle to the roadway so that they would puncture the tires of any vehicle failing to yield to the barrier.

The object of the invention is to provide a sturdy, yet flexible traffic barrier which can be quickly and effectively deployed; while being portable to the extent that it could be just as quickly removed from the roadway and placed in the trunk of a car.

DESCRIPTION OF VIEWS

DETAILED DESCRIPTION

Figure 1:
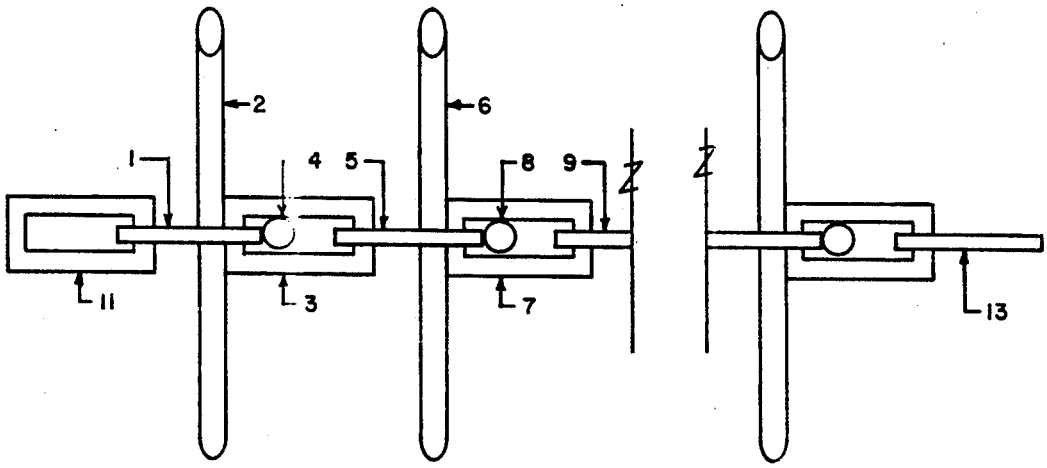
FIG. 1 is a plan view of the front of the traffic barrier chain.
Figure 2:
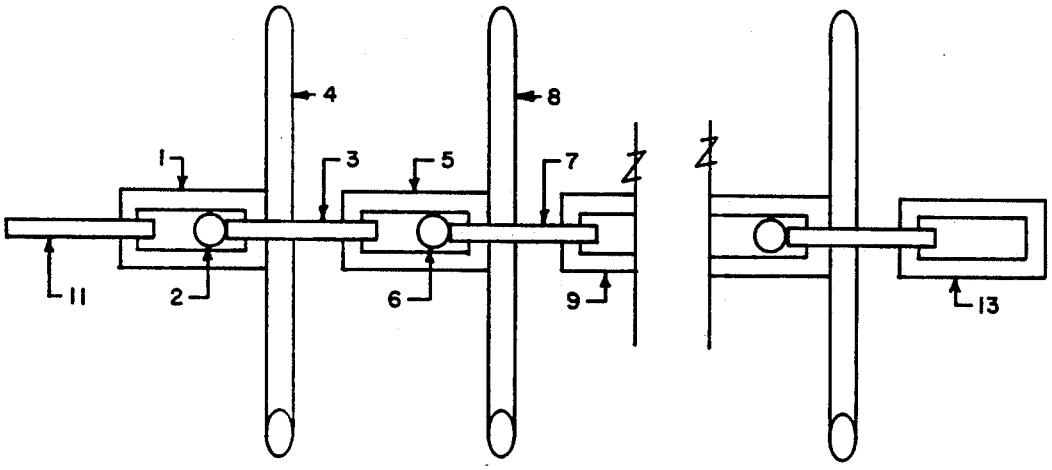
FIG. 2 is a top view of FIG. 1.
Figure 3:
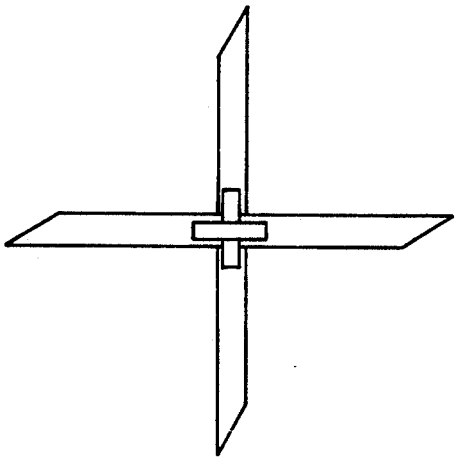
FIG. 3 is a side view of FIG. 1.
Figure 4:
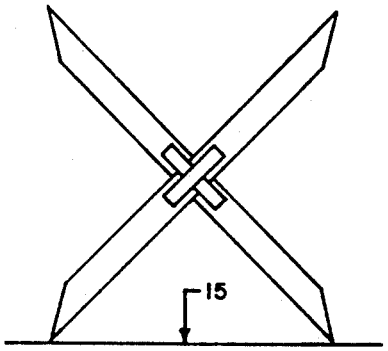
FIG. 4 is a side view of FIG. 1 which shows the actual angle of the splines when the traffic barrier chain is placed on a horizontal or flat surface.

The traffic barrier chain consists of a series of two primary elements, a chain comprising links 1, 3, 5, 7, . . . , and metal splines 2, 4, 6, 8, . . . , shown in FIG. 1 and FIG. 2. The spline 2 is placed through the link 1 to a point midway on the spline 2 and to one side of the link 1 so that the spline 2 comes into contact with the next adjacent link 3. The spline 2 is attached to both the link 1 and adjacent link 3 by either welding or blazing the adjoining surfaces. Attaching the spline 2 in this way makes the joint at link 1 and link 3 rigid. A spline 4 is inserted through link 3 to a point midway on spline 4 and to one side of link 3 so that the spline 4 comes into contact with link 1. The spline 4 is then welded or blazed to the adjoining surfaces of link 1 and link 3. This further adds to the rigidity of the joint connecting link 1 and link 3 and fixes spline 2 and spline 4 at right angles to one another. The joint connecting link 3 and link 5 is not welded or blazed and the links 3 and 5 maintain the ability to swivel in the joint. Spline 6 is inserted through link 5 to a point midway on spline 6 and to one side of link 5 so that spline 6 comes into contact with link 7. The adjoining surfaces are then welded or blazed making the joint connecting link 5 and link 7 rigid. Spline 8 is then inserted through link 7 to a point midway on spline 8 and to one side of link 7 so that spline 8 comes into contact with link 5. The adjoining surfaces are then welded or blazed adding to the rigidity of the joint connecting 1 link 5 and link 7 and fixing spline 8 at a right angle to spline 6. The joint connecting link 7 and link 9 is not welded or brazed so that it retains its flexibilty. This process continues throughout the length of the chain until the desired number of splines are attached. Splines are not attached to the end links, link 11 and link 13 so as to facilitate attaching the traffic barrier chain to another chain, a stake, or a fixed mounting point. Consecutive splines are fixed at right angles to one another. Both ends of each spline are cut or ground to a point or angle, FIG. 3, sufficient enough to puncture an inflatable tire. When set on a surface 15 FIG. 4 the splines will be at a 45 degree angle in relation to the surface 15. When the chain is deployed on a flat horizontal surface and pulled taut the splines intersect the longitudinal axis of the chain at right angles.

While the above description contains many specificities, these should not be construed as limitations on the scope of the invention, but rather as an exemplification of one preferred embodiment thereof. Many other variations are possible, for example the splines could be press-fitted rather than being welded or brazed. The splines rather than round, could be square, triangular, or any of a number of shapes. The splines could be cast or forged as part of the link when the link is manufactured saving further assembly. The traffic barrier chain could be made entirely of a strong lightweight plastic.

I claim:

1. A traffic barrier comprising:

a chain means comprising of a series of interconnected links having openings therethrough with each link passing through the opening of each adjacent link, said links being pivotable relative to each other;

an elongated rod means extending through the opening of at least a plurality of adjacent links of said chain means, said rod means being fixedly attached to said links at approximately a mid-point of said rods means and;

said rod means having each end configured as a sharpened point whereby said points are capable of puncturing vehicle tires.

2. The traffic barrier of claim 1, wherein said links are square shaped.

3. The traffic barrier of claim 1, where in the cross-sectional shape of said elongated rods may be round, square or triangular.

* * * * *